US012318834B2

(12) United States Patent
Hofer et al.

(10) Patent No.: US 12,318,834 B2
(45) Date of Patent: Jun. 3, 2025

(54) METHOD FOR PREVENTING SHAPE CHANGES IN METAL COILS, IN PARTICUALR FOR PREVENTING A COLLAPSING OF NEWLY WOUND HOT COILS

(71) Applicant: Primetals Technologies Austria GmbH, Linz (AT)

(72) Inventors: Roland Hofer, Reichenau im Muehlkreis (AT); Lukas Pichler, Linz (AT); Christoph Salzmann, Linz (AT); Alois Seilinger, Linz (AT); Olaf Silbermann, Linz (AT)

(73) Assignee: Primetals Technologies Austria GmbH, Linz (AT)

( * ) Notice: Subject to any disclaimer, the term of this patent is extended or adjusted under 35 U.S.C. 154(b) by 847 days.

(21) Appl. No.: 17/442,943

(22) PCT Filed: Jan. 21, 2020

(86) PCT No.: PCT/EP2020/051402
§ 371 (c)(1),
(2) Date: Sep. 24, 2021

(87) PCT Pub. No.: WO2020/192980
PCT Pub. Date: Oct. 1, 2020

(65) Prior Publication Data

US 2022/0184687 A1 Jun. 16, 2022

(30) Foreign Application Priority Data

Mar. 26, 2019 (EP) ..... 19165076

(51) Int. Cl.
*B21C 47/24* (2006.01)
*B21C 47/04* (2006.01)
(Continued)

(52) U.S. Cl.
CPC ..... *B21D 43/20* (2013.01); *B21C 47/04* (2013.01); *B21C 47/24* (2013.01); *B21F 3/02* (2013.01);
(Continued)

(58) Field of Classification Search
CPC ..... B21C 47/24; B21C 47/34; B21C 47/3466; B21C 47/26
See application file for complete search history.

(56) References Cited

U.S. PATENT DOCUMENTS 4,271,959 A * 6/1981 Eibe ..... B65G 25/06 242/533.3
8,635,895 B2 1/2014 Felkl

FOREIGN PATENT DOCUMENTS

CN 102089091 A 6/2011
CN 102601165 A 7/2012
(Continued)

OTHER PUBLICATIONS

Russian Office Action received in Russian Application No. 2021123330/05(048699) dated Jun. 9, 2023, p. 14.
(Continued)

*Primary Examiner* — Debra M Sullivan
(74) *Attorney, Agent, or Firm* — Liang & Hennessey LLP; Brian Hennessey

(57) ABSTRACT

The invention relates to a method for preventing shape changes in metal coils, in particular for preventing a collapsing of newly wound hot coils. In the method, a metal coil, in particular a newly wound hot coil, is rotated about its longitudinal axis intermittently in a first rotational direction and then rotated back in a second opposing rotational direction, or further rotated in the first rotational direction.

20 Claims, 3 Drawing Sheets

(51) Int. Cl.

| | |
|---|---|
| ***B21D 43/20*** | (2006.01) |
| ***B21F 3/02*** | (2006.01) |
| ***B65H 49/24*** | (2006.01) |
| ***B65H 49/34*** | (2006.01) |
| *B65H 67/06* | (2006.01) |

(52) U.S. Cl.
CPC ..... *B65H 49/24* (2013.01); *B65H 49/34* (2013.01); *B65H 67/06* (2013.01); *B65H 2301/3322* (2013.01)

(56) References Cited

FOREIGN PATENT DOCUMENTS

| | | | | |
|---|---|---|---|---|
| CN | 109332420 | A | | 2/2019 |
| EP | 1683588 | B1 | | 2/2008 |
| EP | 2629899 | A1 | | 8/2013 |
| JP | 2010207836 | A | | 9/2010 |
| KR | 20100074424 | A | | 7/2010 |
| KR | 101036318 | B1 | | 5/2011 |
| KR | 2012012518 | A | * | 2/2012 |
| KR | 20120121518 | A | | 11/2012 |
| KR | 101420629 | B1 | | 7/2014 |
| SU | 914133 | A1 | | 3/1982 |

OTHER PUBLICATIONS

Chinese Office Action received in Chinese Application No. 202080024287.5 dated Dec. 6, 2022, pp. 9.

International Search Report and Written Opinion received in International Application No. PCT/EP2020/051402 dated Apr. 15, 2020, pp. 15.

European Search Report received in European Application No. 19165076.1 dated Sep. 19, 2019, pp. 8.

* cited by examiner

METHOD FOR PREVENTING SHAPE CHANGES IN METAL COILS, IN PARTICUALR FOR PREVENTING A COLLAPSING OF NEWLY WOUND HOT COILS

CROSS-REFERENCE TO RELATED APPLICATIONS

The present application is a national phase application of PCT Application No. PCT/EP2020/051402, filed Jan. 21, 2020, entitled "METHOD FOR PREVENTING SHAPE CHANGES IN METAL COILS, IN PARTICULAR FOR PREVENTING A COLLAPSING OF NEWLY WOUND HOT COILS", which claims the benefit of European Patent Application No. 19165076.1, filed Mar. 26, 2019, each of which is incorporated by reference in its entirety.

BACKGROUND OF THE INVENTION

1. Field of the Invention

The invention relates to a method for preventing shape changes in metal coils, in particular for preventing a collapsing of newly wound hot coils, which collapse can occur, for example, in the production of steel products, such as metal strips, in hot rolling mills or hot rolling trains.

2. Description of the Related Art

In the production of steel, there is a trend toward the production of increasingly high-, higher- and very high-strength steel grades, including in the production of metal strips.

This trend also necessitates higher standards in the production process of steel products with such steel grades, especially in the hot rolling of these steel products in hot rolling mills/hot rolling trains.

This is because, owing to the increasingly high-, higher- and very high-strength steel grades, a phase transformation of the steel product, for example from austenite to ferrite, can occur not only in a cooling section of a hot rolling mill but also—after the cooling section—in a coiler (in which the steel/metal strip is wound into a—newly wound—hot coil after a rolling step/rolling process) during transport—of the newly wound hot coil which has been removed from the coiler (and, if appropriate, also already bound)—to a coil store or in a coil store of a hot rolling mill (in which the newly wound hot coil is stored) ("delayed phase transformation"), particularly in the case of those grades which are subsequently cold rolled.

Phase transformations in the product, such as the metal coil or the newly wound hot coil, lead in turn to volume changes and shape changes/deviations ("collapse") there, which are unwanted and/or which can lead to serious problems, particularly in the transportation of coils and in further processing plants (for example there when mounting on an uncoiling mandrel). A special form of this collapse in the case of a steel product is what is referred to as "ovalization", in which—here in the case of a metal/hot coil—a shape change/deviation from an initially (approximately) round shape to an oval shape occurs.

In the case of metal strips with such special steel grades, e.g. high-carbon steels, press-hardened steels or multi-phase steels, or in the production of such metal strips, it is thus possible, particularly during coiling or during coil transport, where the metal strip is in the form of a (wound) coil, for delayed phase transformation and thus the change in volume or shape in the product or coil, i.e. the (unwanted) collapse or ovalization, to occur.

EP 1 683 588 B1 discloses a device for transporting very heavy metal strip coils produced after rolling processes by winding up rolled metal strips. This device comprises pallets used in a circulating system and roller conveyors conveying said pallets onward. Here, a pallet consists of mutually spaced longitudinal members and a coil-supporting saddle which bridges the latter and has opposing supports enclosing a supporting angle.

In order to make possible an operationally reliable transport system in spite of the cumulative effects of load and heat, the pallet for transporting a coil is designed with contouring of at least its longitudinal beams, said contouring being precalculated under load and heat influence and compensating for vertical and horizontal deformation.

KR101695986 B1 discloses a further device for transporting metal coils, i.e. what is referred to as a "coil car". In order to bring a metal coil on the transport device into a desired position, rotatable support rollers are provided on the transport device, by means of which support rollers a supported metal coil can be rotated into the desired position.

EP 2 629 899 B1 also describes a device for transporting metal coils. This provides a "fixed" coil/support saddle, provided with heat shields, on the device, on which the metal coil is deposited during transportation.

U.S. Pat. No. 4,271,959 A discloses a device based on the walking beam principle for transporting newly wound hot coils away from the downcoiler of a hot rolling mill. During transport by means of a multiplicity of movable but stationary mechanical actuators, the coils are also rotated about their longitudinal axis by a certain angular amount during each lifting movement. Although this successfully counteracts deformation of the coils, a correspondingly high number of individual strokes is necessary for a relatively long transport distance, and this can lead to damage to the circumferential surface of the coils. It is also possible for a coil to come to rest during the transport process on its strip end resting on the outside, which can lead to mechanical impressions in the underlying wound layers owing to the intrinsic weight of the coils.

KR 101 036 318 B1 discloses a transfer device for coils, by means of which a shape change (ovalization) of the coils can be reversed. A first conveyor belt with support devices for individual coils transports the coils one after the other to a transfer lifting station, at which a single coil is received by a vertically adjustable and laterally displaceable lift truck and is transferred to a second, similar conveyor belt. If necessary (ovalization), the relevant coil can be temporarily deposited by the lift truck on a group of rotatably driven rollers during the transfer process, where it is rotated by the latter by 90° in order to compensate for the ovalization. Although an already existing coil deformation can be compensated with the disclosed invention, it is not possible to prevent a disadvantageous deformation from the outset or to counteract such a deformation during the entire transport process owing to the turning process taking place only at one point.

KR 2012 012518 A discloses a transport carriage which can be moved in one direction and has four support rollers for receiving a hot coil. For the purpose of rotating a coil situated on the transport carriage, at least two axially opposite support rollers are each connected to a drive fixed to the transport carriage, wherein the drives must be synchronized. For abrupt stopping of the rotation process (e.g. owing to an emergency situation), braking devices fixed to the transport carriage are furthermore provided. To correct a coil deformation (ovalization), KR 101 036 318 B1 proposes to rotate the coil by 90° on the transport carriage. Although ovalization of a coil situated on a transport carriage can be counteracted with the disclosed transport carriage, the rotary drives and brakes involve an increased dead weight and an increased design and energy expenditure for coil transport.

KR 101 420 629 B1 proposes a spreading device in combination with a stationary coil depositing device with rotationally driven support rollers, on which an ovalized coil is initially deposited. The spreading device is introduced into the coil eye in a horizontal orientation, and the two parts are then rotated through 90°. Owing to its own weight, the oval coil sags in the vertical direction until the spreading device blocks a further collapse. Subsequent cooling stabilizes the coil whose shape has been corrected in this way, enabling the spreading device to be collapsed and removed again from the coil eye. Once again, although restoration of an originally round coil shape is possible, prevention from the outset is not possible and it can only be carried out at certain points, i.e. not during coil transport.

JP 2010 207836 A proposes a transport carriage with rotatably driven support rollers to prevent shape changes of a coil at elevated temperature, wherein the coil is rotated continuously at at least 1 revolution per minute on the transport carriage during the transport process and the rotary motion is started at least 30 seconds before the coil is transferred to the coiler of the following processing station. Although this makes it possible to prevent deformation of the coil, the continuous rotary motion of the coil—especially in the case of relatively long transport processes—leads to unnecessarily high wear of the outer surface of the coil.

SUMMARY OF THE INVENTION

It is the underlying object of the invention to provide a method by means of which problems in the production of metal coils, in particular problems in the case of newly wound (hot) coils, can be avoided or, more specifically, collapse or ovalization in the case of newly wound (hot) coils can be prevented. In particular, the disadvantages of known solutions are to be avoided and movements of the coil to be used as sparingly as possible in order to prevent unnecessary damage to the coil surface as far as possible.

This object is achieved by methods for preventing shape changes in metal coils, in particular for preventing a collapsing of newly wound hot coils, having the features of the respective independent claim. Advantageous developments of the invention or of the (or all of the) methods according to the invention form the subject matter of dependent claims and of the following description.

In a method for preventing shape changes in metal coils, it is provided that a metal coil, in particular a newly wound hot coil, in particular a coil composed of a high-carbon steel, a press-hardening steel, a multi-phase steel or an advanced high-strength steel grade (AHSS) steel, is intermittently rotated about its longitudinal axis forward in a first direction of rotation and then back in a second, opposite direction of rotation, or rotated further in the first direction of rotation.

"Metal coil" (also generally referred to just as a "coil") refers to a metal product produced by winding a metal strip.

In this context, "newly wound" may refer to a metal coil which is produced after a rolling process by winding a rolled metal strip.

"Hot coil" may refer to a metal coil made from a hot-rolled metal strip.

In this context, "intermittent", in the general meaning of "running with interruptions/pauses", means that, between the forward and the (reverse) backward rotation or between the forward and the further rotation, there is a—consciously or consciously/intentionally inserted/set—temporal (rotation) interruption/(rotation) pause (short interruption/pause).

The forward rotation, the interruption/pause and the (reverse) backward rotation or the further rotation are also often referred to in simplified form below as (a) "cycle".

This "conscious" or "consciously inserted" pause (between the forward and the (reverse) backward rotation or between the forward and the further rotation) is an—intentional—pause (also referred to hereinafter for short as a "cycle pause"/"intra-cyclical pause") which goes beyond a, possibly, mere reversal of the direction of rotation (during the forward and (reverse) backward rotation) by "mere" switching between the directions of rotation or which goes beyond a mere (short), in particular unwanted, stall between the forward and the further rotation.

In this context, consciously or intentionally also means that a pause duration/length is intentionally selected and/or set (in contrast to mere "switching of the directions of rotation" or an unwanted stall), in particular as a function of one or more specific parameters. This means that the forward and backward rotation or the forward and further rotation is intentionally interrupted for a predeterminable pause.

During this pause or pause duration, the metal coil or the newly wound hot coil expediently remains at rest, or at least no rotational manipulation of the metal/hot coil takes place.

It is not detrimental if the cycle of the metal/hot coil has superimposed upon it another action/manipulation of the metal/hot coil, e.g. a translational movement of the metal/hot coil—during the cycle.

In particular, the pause duration (or rest duration/length of the resting phase) between the forward and the (reverse) backward rotation or between the forward and the further rotation can be selected (that is to say therefore can be consciously selected/set—depending on the material) according to a material of the metal coil, in particular of the newly wound hot coil.

A parameter determining the pause duration or rest duration/phase can also be a size, a circumference, a diameter, a weight and/or a temperature of the metal coil, in particular of the newly wound hot coil, and/or even a thickness of the metal strip wound to form the metal/hot coil.

A plurality of parameters or a plurality of parameters in combination can also be used for the determination of the pause duration or rest duration/phase between the forward and the (reverse) backward rotation or the forward and the further rotation, or said parameters can be referred to or used in defining the pause duration or rest duration/phase.

Furthermore, in particular, the pause duration or rest duration/phase between the forward and the (reverse) backward rotation or the forward and the further rotation of the metal coil, in particular of the newly wound hot coil, can be in a range (min./max. pause duration) of about 50 s to 300 s, in particular 100 s to 300 s, more particularly of about 150 s to 250 s.

It is also possible to provide a pause duration of about 200 s, which is expedient in the case of metal products.

The method is based on the insight gained that the cycle, i.e. the intermittent forward and (reverse) backward rotation or forward and further rotation of the metal/hot coil, ensures that the phase transformation in the metal coil or newly wound hot coil remains without significant effect on the coil shape. This circumstance is based on the fact that the phase transformations mentioned at the outset and the associated volume changes do not lead to continuous shape changes/deviations of the coil in question, but rather these occur in discrete steps, namely, for example, when the static friction between adjacent turns of the coil falls below a critical value. In other words, the coil settles down bit by bit, under its own weight for example. A continuous change in the spatial orientation of the coil to maintain the original winding shape is therefore not absolutely necessary.

Through the cycle, the metal/hot coil moves into changed, in particular "antipodal", locations/positions, in which shape changes that occur in the metal/hot coil (due to gravity effects) are "compensated".

In this way, i.e. as a result of the shape change compensation in the metal/hot coil during the intermittent forward and (reverse) backward rotation or intermittent forward and further rotation, it is possible to counteract the collapse or the ovalization of a metal coil, in particular of a newly wound hot coil.

Problems in this respect, such as those which can then occur, for example, when a coil is mounted on an uncoiling mandrel (when the coil to be mounted is collapsed/ovalized), can thus be avoided.

Provision can expediently also be made for the metal coil, in particular the newly wound hot coil, to be rotated forward and backward several times or to be further rotated several times, e.g. two, three, four or even more times, which is particularly beneficial for the formation or maintenance of a round shape of the metal/hot coil. In short, several cycles are run with the metal/hot coil.

In particular, several cycles with the metal/hot coil ensure a pronounced "antipodal" effect—and thus ensure, in particular, that the phase transformation remains without significant effect on the coil shape.

It is also expedient that such a—conscious—pause/interruption, such as the "cycle pause" (within a cycle) or "intra-cyclical pause", is also provided between two cycles (here then "inter-cycle pause" or "pause between cycles" for short) or between two further rotations (here also "inter-cycle pause" or "pause between cycles" for short) (all then intermittent processes).

The inter-cycle pause or pause between cycles can be determined according to the corresponding parameters, such as the cycle pause or intra-cyclical pause, such as the material, the size, the circumference, the diameter, the weight and/or the temperature of the metal/hot coil and/or the metal strip thickness of the metal/hot coil.

The number of forward and (reverse) backward rotations or the number of cycles as well as the number of further rotations can also be made dependent on one or more parameters, thus, for example, also on a material, a size, a circumference, a diameter, a weight and/or a temperature of the metal/hot coil and/or a metal strip thickness of the metal/hot coil.

Preferably, the "very first/initial" forward rotation (in the first direction of rotation) takes place counter to a coiling direction of the metal coil or of the newly wound hot coil.

Furthermore, provision can also expediently be made for an angle of rotation of the forward rotation and/or an angle of rotation of the (reverse) backward rotation of the newly wound hot coil and/or an angle of rotation of the further rotation to be set according to a material, a size, a circumference, a diameter, a weight and/or a temperature of the metal coil, in particular of the newly wound hot coil, and/or a metal strip thickness of the metal/hot coil.

Moreover, the forward rotation in the first direction of rotation and/or the reverse rotation in the second, opposite direction of rotation and/or the further rotation in the first direction of rotation can take place through an angle of rotation from a range of about 22.5° to 135°, in particular from about 45° to 135°, more particularly from about 75° to 105°, further in particular also through about 90°.

It is particularly expedient if the forward rotation in the first direction of rotation and the reverse rotation in the second, opposite direction of rotation or if the forward rotation in the first direction of rotation and the further rotation in the first direction of rotation take place through the same angle of rotation in each case.

Alternatively, different angles of rotation can also be carried out here.

It is furthermore also possible to envisage that, before the start of the "very first/initial" forward rotation in the first direction of rotation, such a—conscious—pause or rest phase ("preliminary pause"), such as the "cycle pause" or "intra-cyclical pause" (within a cycle) or the "inter-cycle pause" or "pause between cycles" (between two cycles), is likewise provided.

To put it differently or clearly, a certain rest duration is allowed to expire—for example after the metal/hot coil has been removed from a coiler—before the "very first/initial" forward rotation in the first direction of rotation or before the "very first/initial" cycle in the metal/hot coil is begun.

The "preliminary pause" can be determined according to the corresponding parameters, such as the cycle/intra-cyclical pause or inter-cycle pause/pause between cycles, such as the material, the size, the circumference, the diameter, the weight and/or the temperature of the metal/hot coil and/or the metal strip thickness of the metal/hot coil.

In particular, it may be expedient here if the "very first/initial" forward rotation (of the "very first/initial" cycle) is begun about 100 s to 300 s, in particular about 150 s to 250 s, further in particular about 200 s, after the removal of the metal/hot coil from a coiler.

Notwithstanding this, it is expedient to start as early as possible with the "first/initial" forward rotation (of the cycle or of the "very first/initial" cycle).

In order to prevent mechanical damage to the metal/hot coil, it is also expedient for the forward and/or reverse rotation and/or the further rotation of the metal coil, in particular of the newly wound hot coil, to take place in such a way that the metal coil, in particular the newly wound hot coil, is not rotated beyond a coil start on an outer circumference of the metal coil, in particular of the newly wound hot coil.

According to a preferred development, provision is made for the method or the cycle or cycles to be carried out after the metal/hot coil has been removed from a coiler and/or after or before binding, marking, measuring, weighing and/or inspection (in general post-processing) of the metal/hot coil and/or before the metal/hot coil has been deposited.

In other words, provision can be made for the metal coil, in particular the newly wound hot coil, to be removed from a coiler and/or subjected to intermediate treatment before the first cycle or the "very first/initial" forward rotation and/or to be subjected to intermediate treatment and/or deposited in a coil store after the "last" cycle or the "very last/final" (reverse) backward rotation or "very last/final" further rotation.

In short, the method may be carried out between removal from the coiler and deposition in the coil store or between the coiler and the coil store.

Provision can furthermore also be made in this way for the metal coil, in particular the newly wound hot coil, to be sampled and/or strapped and/or weighed and/or marked and/or measured.

The method is expediently carried out on the metal/hot coil in/during a phase transformation of the metal/hot coil, in particular the phase transformation from austenite to ferrite.

Here too, it may be particularly expedient for the method to be carried out on the metal/hot coil until the phase transformation of the metal/hot coil, in particular the phase transformation from austenite to ferrite, has been completed.

If necessary, a certain continuation of the method—"for safety's sake"—can also be carried out (during which the method is carried out beyond the end of the phase transformation in the metal/hot coil). A continuation duration can once again be set according to a material, a size, a circumference, a diameter, a weight and/or a temperature of the metal coil, in particular of the newly wound hot coil, and/or a metal strip thickness of the metal/hot coil.

According to a further development, a transport device—for the metal/hot coil —, for example a pallet or a transport carriage (such as a modular coil shuttle (MCS) car) or, if appropriate, a walking beam system (or in combination with a walking beam system), is provided—with a coil support having at least a first rotatable and a second rotatable transport roller, in particular wherein at least one or (the) two (or—in the case of even more rotatable transport rollers—all of the) rotatable transport rollers is/are drivable.

This transport device can then be used for carrying out the method or its further developments, particularly if the transport rollers are drivable (or are driven).

Driven transport rollers can be implemented by means of drives/drive units integrated (into the transport rollers), e.g. electric drives/motors (or hydraulically), or external (preferably mechanically) connectable/couplable drives/drive units.

Rollers or transport rollers can have recesses in the region of binder bands, so that the binder bands do not leave any impressions on the metal/hot coil.

By means of these transport roller drives, the forward and/or (reverse) backward rotation and/or further rotation can then be effected in the method.

A controller is expediently also provided, which controls the drivable rollers or the drives thereof in accordance with the method to be carried out. In this case, for given strip/coil parameters, such as, in particular, the material, the size, the circumference, the diameter, the weight and/or the temperature of the metal/hot coil and/or the metal strip thickness of the metal/hot coil, the controller can determine corresponding process parameters, such as, in particular, angle of rotation, rotational speed, pause duration and/or direction of rotation, and can control/carry out the method according to these.

Furthermore, a transport system—for the metal/hot coil—can also be provided—with a transport device, e.g. a pallet or a transport carriage (such as a modular coil shuttle (MCS) car), with a coil support, in particular having at least a first rotatable and a second rotatable transport roller, and with a transport station, for example a floor rolling station, with a coil support having at least a first rotatable and a second rotatable transport roller, wherein at least one or (the) two (or—in the case of even more rotatable transport rollers at the transport station—all of the) rotatable transport rollers is/are drivable.

This transport system can then be used for carrying out the method or its further developments.

In particular, provision can then be made here for the method to be carried out on the transport station. The metal/hot coil can then be moved (temporarily) from the transport device to/into the transport station—for example in a type of discharge station—where the method is carried out, and then moved (back) again into/onto the transport device.

In particular, the transport device can be used to transport the metal/hot coil after removal from the coiler to the coil store, or in particular from the coiler to the discharge station and from there on to the coil store.

Here too, the controller can once again be provided, which controls the drivable rollers or the drives thereof in accordance with the method to be carried out.

In a further method for preventing shape changes in metal coils, in particular for preventing a collapsing of newly wound hot coils, it is provided that a metal coil, in particular a newly wound hot coil, is rotated about its longitudinal axis, forward in a first direction of rotation and backward without a pause in a second, opposite direction of rotation, wherein the forward and reverse rotation take place several times in succession without a pause.

To put it differently or briefly and clearly, according to this further method, the metal/hot coil is rotated continuously forward and backward (in reverse) without a pause, i.e. without the cycle pause/intra-cyclical pause and without the inter-cycle pause/pause between cycles, (between the rotations).

In particular, what has been stated by way of stipulation and further development, in particular with respect to the rotations, such as the angle of rotation, and/or the control thereof, applies in corresponding fashion to this further method.

In yet another method for preventing shape changes in metal coils, in particular for preventing a collapsing of newly wound hot coils, it is provided that a metal coil, in particular a newly wound hot coil, is rotated about its longitudinal axis, without interruption, in one and the same direction of rotation, in particular in a coiling direction of the metal coil, during a transport operation, in particular between removal from a coiler and deposition in a coil store.

To put it differently or briefly and clearly, according to this further method, the metal/hot coil can be rotated continuously in one and the same direction, preferably in the coiling direction, in particular slowly, for example at about >5 min per revolution, in particular about 10 min per revolution, during the entire transport operation between the coiler and the coil store or between removal from the coiler and deposition in the coil store.

In particular, what has been stated by way of stipulation and further development, in particular with respect to the rotations, such as the angle of rotation, and/or the control thereof, applies in corresponding fashion to this additional further method.

The description given hitherto of advantageous embodiments of the invention contains numerous features which are in some cases reproduced together in groups in the individual dependent claims. However, these features can expediently also be considered individually and combined into other meaningful combinations. In particular, these features can be combined individually and in any suitable combination with the methods according to the invention.

Even if some terms are in each case used in the singular or in combination with a quantifier in the description and/or in the patent claims, there is no intention to restrict the scope of the invention to the singular or the respective quantifier in respect of these terms. Moreover, the words "a" and "an" should not be interpreted as quantifiers but as indefinite articles.

The above-described properties, features and advantages of the invention and the manner in which these are achieved will become more clearly and distinctly comprehensible in conjunction with the following description of the exemplary embodiments of the invention, which is/are explained in greater detail in conjunction with the drawings/figures (identical component parts/components and functions have identical reference signs in the drawings/figures). The exemplary embodiment/s serve/s to explain the invention and do not restrict the invention to the combinations of features, including functional features, indicated therein. In addition, suitable features of any exemplary embodiment can furthermore also be explicitly considered in isolation, removed from an exemplary embodiment, introduced into some other exemplary embodiment to supplement the latter, and combined with any of the claims.

BRIEF DESCRIPTION OF THE DRAWINGS

The above-described properties, features and advantages of this invention and the manner in which In the drawings.

DETAILED DESCRIPTION

Intermittent coil rotation, continuous forward and (reverse) backward coil rotation without a pause and continuous coil rotation in one and the same direction during the transport process—to prevent collapse/ovalization of a coil (FIGS. 1 to 3) is described in the following.

Figure 1:
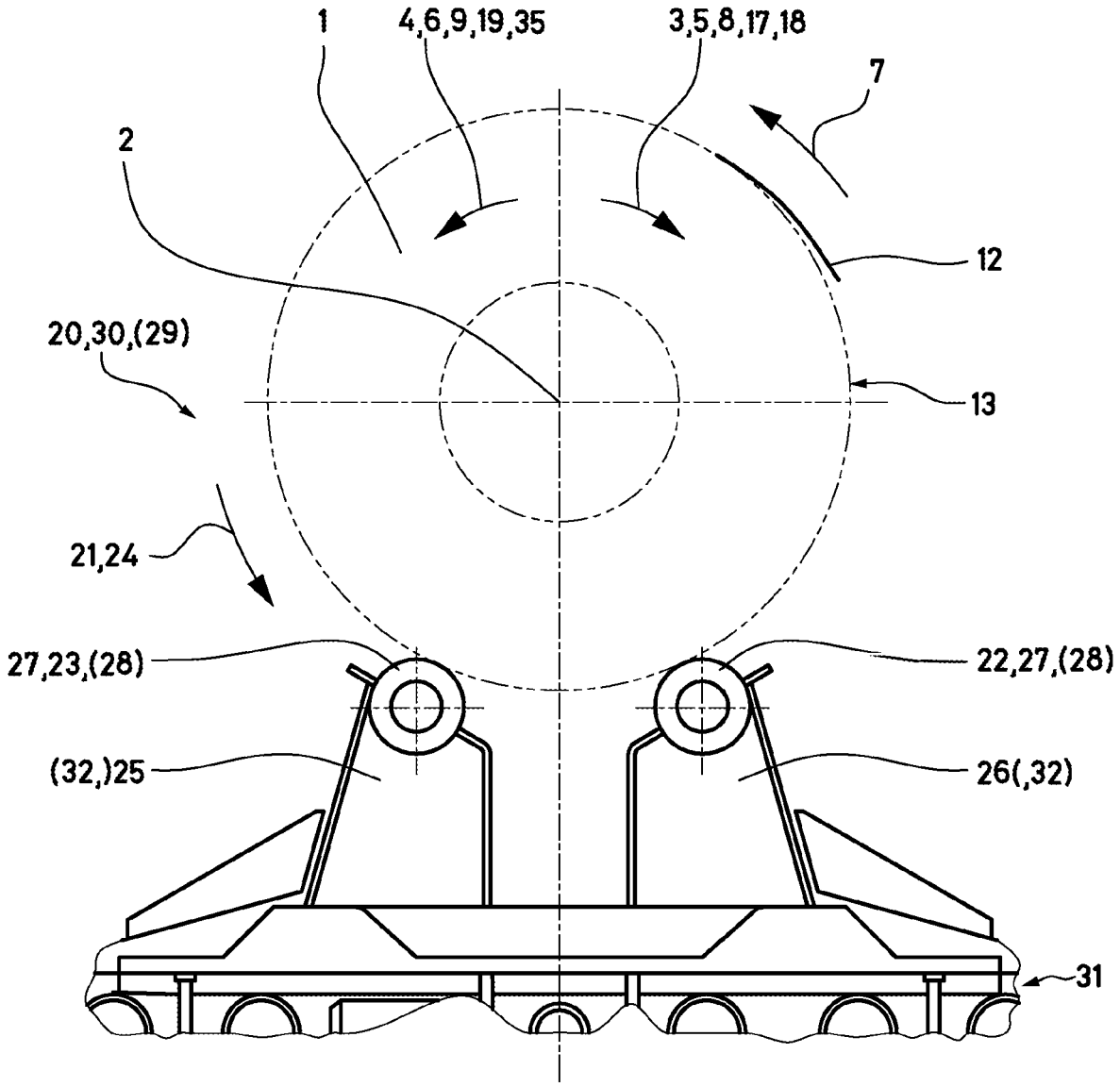
FIG. 1 shows a pallet system for carrying out a coil rotation according to a first embodiment.
Figure 2:
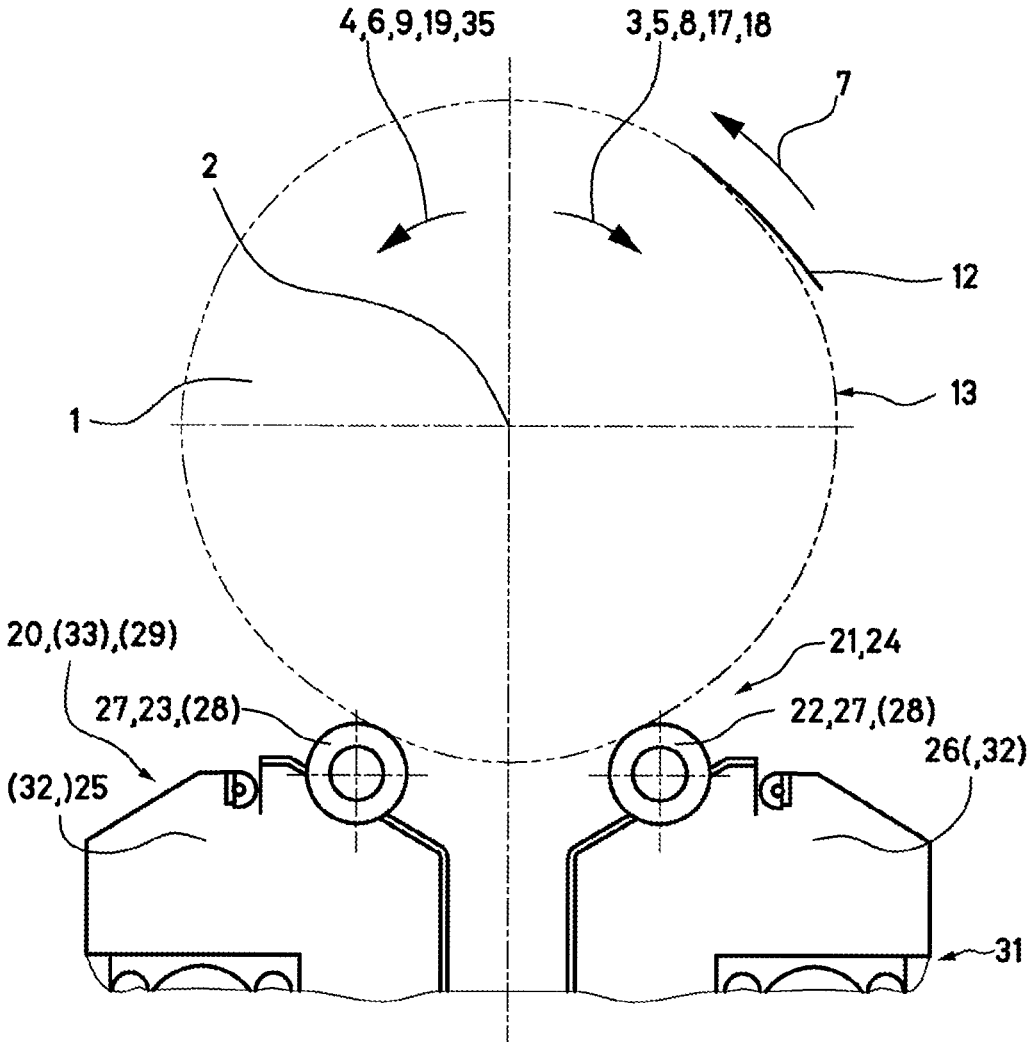
FIG. 2 shows an MCS system for carrying out a coil rotation according to a second embodiment.
Figure 3:
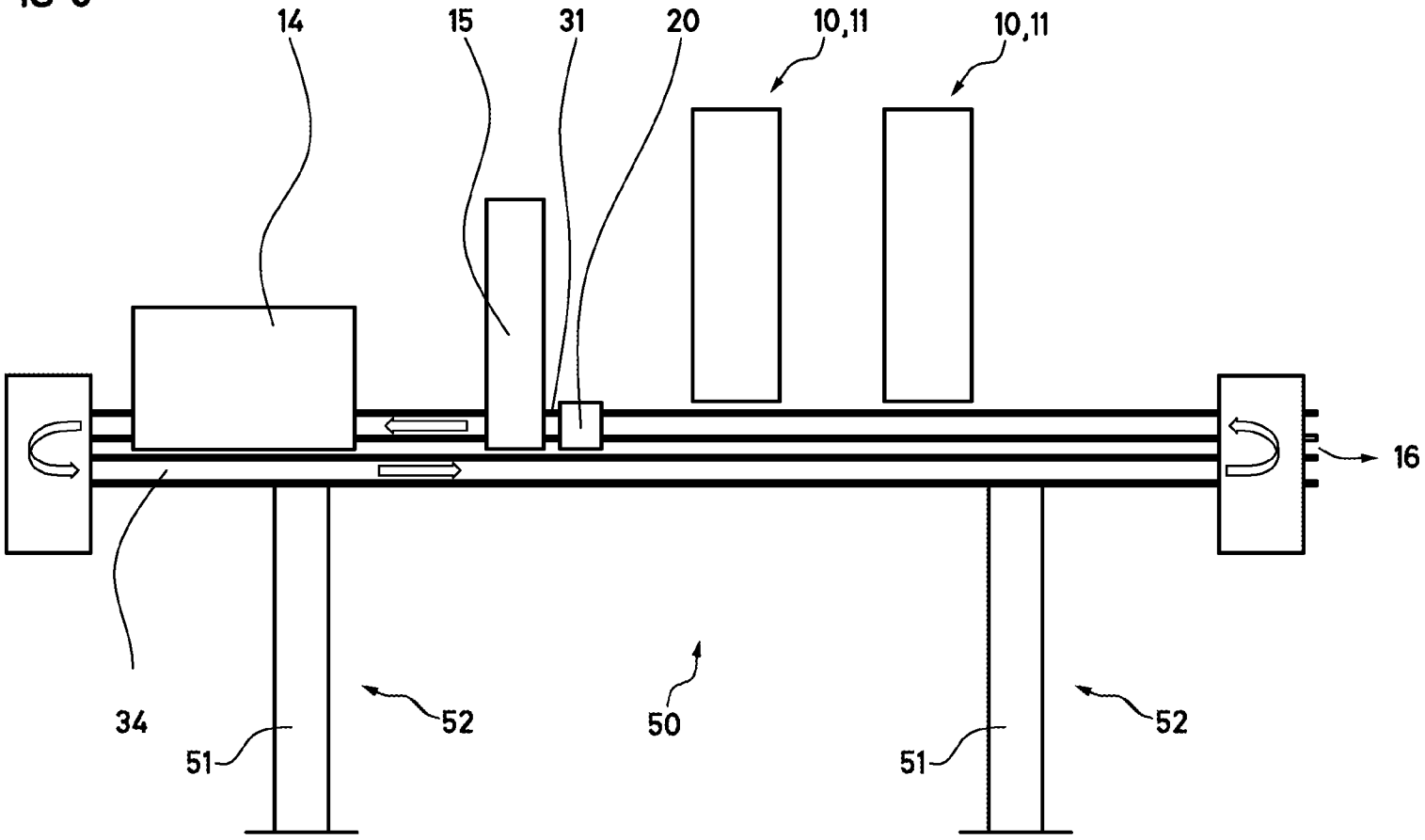
FIG. 3 shows a discharge station with a floor rolling station for carrying out a coil rotation according to a third embodiment.

The embodiments described below in accordance with FIGS. 1 to 3 show possibilities or implementations of how collapse or ovalization of a newly formed hot coil 1 (abbreviated to "coil" 1) can be prevented.

Here, the embodiments relate in each case to a segment of the processing sequence in the production of a metal strip in a hot rolling mill.

The metal strips to be produced are—there is a trend toward this—steels of new high-, higher- or very high-strength steel grades, such as high-carbon steels, press-hardening steels, multi-phase steels or advanced high-strength steel grade (AHSS) steels.

During the processing sequence in the production of the metal strip, it is necessary that the metal strip which has been wound on a coiler 10 to form the coil 1 after a hot rolling process, i.e. the newly wound hot coil 1 or coil 1 (which usually has a temperature of up to 850° C. and a weight of up to 50 t) should be transported away from the coiling station or coiler 10 and toward various processing stations (14, 15).

In the individual processing stations (14, 15), the coils 1 are post-processed, for example bound 15, marked, weighed 14, measured and/or inspected, before they are deposited in a coil store 16.

For the transport process required in this case for the coil 1—away from the coiler 10 and toward the coil store 16—a transport device 20 or transport system 50 is required, which will be described below—in various embodiments.

Owing to the increasingly strong steel grades in the production of metal strips, phase transformation in the metal strip thus also takes place during this transport process, which phase transformation in turn leads to unwanted volume changes and shape changes/deviations ("collapse"/"ovalization") in the coil 1.

Intermittent coil rotation to prevent collapse/ovalization of a coil is described in the following.

In order to prevent this ovalization of the coil 1, it is provided that the coil 1 to be transported is rotated intermittently (about its longitudinal axis 2) forward 3 away from the coiler 10 and toward the coil store 16 and backward (in reverse) 4 (or alternatively rotated further 17)—if appropriate repeatedly—during the transport process.

Transport devices/systems described below are set up for such coil treatment/rotation 3, 4 (, 17) and can thus contribute to preventing the collapse or ovalization of the coil 1.

Pallet (Circulation) System 30 (FIG. 1)

FIG. 1 shows a pallet 20 of a pallet circulation system 30, which pallet circulation system 30 transports coils 1 away from the coiler 10 toward the coil store 16—by means of pallets 20 moved on a conveying section 31 by pallet circulation carriages.

In this case, the coils to be transported are loaded along their longitudinal axis onto the respective pallet circulation carriage.

For this purpose, a newly wound hot coil 1 or coil 1 is removed 11 from the coiler 10 and deposited on the pallet 20, as FIG. 1 illustrates. The pallet 20 is moved via the conveying section 31 (if appropriate via the processing stations 14, 15) to the coil store 16, in which the coil 1 is then deposited, whereby the coil 1 is then or has been transported in this way from the coiler 10 to the coil store 16.

As FIG. 1 shows, the pallet 20 provides a coil support 21 in the form of a support saddle 24, on which the coil 1 to be transported is deposited or, as FIG. 1 shows, has been deposited.

For this purpose, as FIG. 1 also shows, this support saddle 24 has two saddle supports 25, 26, which are arranged at a distance from one another and which preferably each have a roller 22, 23 drivable by means of an integrated drive 27 (not visible).

By means of corresponding adjustment systems 32 on the pallet 20 or on the saddle supports 25, 26 (not visible), the two rollers 22, 23 forming the coil support 21/coil saddle 24 can be moved horizontally and vertically, thereby making it possible to adjust the height and/or spacing of the rollers 22, 23—and thus to adapt the coil support 21 to the coils 1 to be transported.

The integrated drives 27 of the rollers 22, 23 carrying the coil 1 are controlled by means of a controller 29, enabling the coil 1 deposited on them to be rotated—in a controlled manner—about its longitudinal axis 2.

The coil rotation 3, 4 (, 17) takes place according to a predeterminable cycle regime, which—if appropriate several times—provides an intermittent forward 3 and (reverse) backward rotation 4 (or alternatively further rotation 17) ("cycle").

For this purpose, the controller 29 determines the corresponding rotation parameters, such as the start of the rotation, direction of rotation 5, 6, duration of a rotation, pause duration between two rotations, rotational speed, angle of rotation 8, 9, number of rotations/cycles, start/end of the overall cycle and many other factors—according to the material, the size, the circumference, the diameter, the weight and the temperature as well as the metal strip thickness of the coil 1—and controls the integrated drives 27 of the rollers 22, 23 in accordance therewith.

Possible cycle or rotation regimes can be carried out as follows:

1.

Steel grade: high-/higher-/very high-strength steel, e.g. AHSS steel

Coil weight: 20 t-30 t

Start of the rotation regime: 1 min after removal from coiler 10 (11)

Number of cycles: 10

Cycle pause/intra-cyclical pause between the forward 3 and the (reverse) backward rotation 4 (or the further rotation 17): 1 min Pause between two cycles/inter-cycle pause or pause between cycles: 1 min Angle of rotation 8 of the forward rotation 3: 90°

Angle of rotation 9, 18 of the (reverse) backward rotation 4 or the further rotation 17: 90°

First/initial direction of rotation 5: preferably counter to coiling direction 7

Note: Preferably no rotation 3, 4, 17 beyond the coil/strip start 12 at the outer circumference 13. Post- and intermediate processing operations 14, 15 are carried out after completion of the cycle or rotation regime.

2.

Steel grade: high-/higher-/very high-strength steel, e.g. high-carbon steel

Coil weight: 30 t-45 t

Start of the rotation regime: 200 s after removal from the coiler 10 (11)

Number of cycles: 15

Cycle pause/intra-cyclical pause between the forward 3 and the (reverse) backward rotation 4 (or the further rotation 17): 1.5 min Pause between two cycles/cycles pause or inter-cycle pause: 1.5 min Angle of rotation 8 of the forward rotation 3: 75°

Angle of rotation 9, 18 of the (reverse) backward rotation 4 or the further rotation 17: 75°

First/initial direction of rotation 5: preferably counter to coiling direction 7

Note: Preferably no rotation 3, 4, 17 beyond the coil/strip start 12 on the outer circumference 13. Post- and intermediate processing operations 14, 15 are carried out after completion of the cycle or rotation regime.

3.

Steel grade: high-/higher-/very high-strength steel, e.g. multi-phase steel

Coil weight: 25 t-40 t

Start of the rotation regime: 10 s after withdrawal from the coiler 10 (11)

Number of cycles: 8 or until completion of the phase transformation

Cycle pause/intra-cyclical pause between the forward 3 and the (reverse) backward rotation 4 (or the further rotation 17): 2 min Pause between two cycles/cycles pause or inter-cycle pause: 2 min Angle of rotation 8 of the forward rotation 3: 90°

Angle of rotation 9, 18 of the (reverse) backward rotation 4 or the further rotation 17: 90°

First/initial direction of rotation: preferably counter to coiling direction 7

Note: Preferably no rotation 3, 4, 17 beyond the coil/strip start 12 at the outer circumference 13. Post- and intermediate processing operations 14, 15 are carried out after completion of the cycle or rotation regime.

MCS System 33 (FIG. 2)

FIG. 2 shows a transport carriage 20, a "modular coil shuttle (MCS) car" (MSC for short) 20, by means of which coils 1 can be transported via the conveying section 31 away from the coiler 10 toward the coil store 16 (and also rotated 3, 4, 17).

For this purpose, a newly wound hot coil 1 or the coil 1 is removed 11 from the coiler 10 and deposited on the MCS 20—in accordance with the pallet circulation system 30 (FIG. 1)—as FIG. 2 illustrates. The MCS 20 is moved (if appropriate via the processing stations 14, 15) to the coil store 16, in which the coil 1 is then deposited, whereby the coil 1 is then or has been transported in this way from the coiler 10 to the coil store 16.

As FIG. 2 shows, the MCS 20—in a manner corresponding to the pallet 20 (FIG. 1)—provides a support saddle 24 (as a coil support 21), on which the coil 1 to be transported is deposited or, as FIG. 2 shows, has been deposited.

For this purpose, as FIG. 2 also shows, this support saddle 24 has two saddle supports 25, 26, which are arranged at a distance from one another and which each have a roller 22, 23 drivable by means of an integrated drive 27 (not visible).

By means of corresponding adjustment systems 32 on the MCS 20 or on the saddle supports 25, 26 (indicated, in FIG. 2), the two rollers 22, 23 forming the coil support 21/coil saddle 24 can be moved horizontally and vertically, thereby making it possible to adjust the height and/or spacing of the rollers 22, 23—and thus to adapt the coil support 21 to the coils 1 to be transported.

The integrated drives 27 of the rollers 22, 23 carrying the coil 1 are controlled by means of a controller 29, enabling the coil 1 deposited on them to be rotated 3, 4, 17—in a controlled manner—about its longitudinal axis 2.

The coil rotation 3, 4, 17 takes place according to a predeterminable cycle regime (cf. this in the pallet circulation system 30), which—if appropriate several times—provides an intermittent forward 3 and (reverse) backward rotation 4 or further rotation 17 ("cycle").

For this purpose, the controller 29 determines the corresponding rotation parameters (see above in the pallet circulation system 30), such as the start of the rotation 3, 4, 17, the angle of rotation 8, 9, 18, the direction of rotation 5, 6, the duration of a rotation 3, 4, 17, the pause duration between two rotations, the rotational speed, the number of rotations/cycles, the start/end of the overall cycle and many other factors—according to the material, the size, the circumference, the diameter, the weight and the temperature as well as the metal strip thickness of the coil—and controls the integrated drives 27 of the rollers 22, 23 in accordance therewith.

Possible cycle or rotation regimes are as described above.

As an alternative (not shown) in the pallet circulation system 30 and the MCS system 33—with rollers 22, 23 driven in an integrated manner there—it is also possible to provide rollers 22, 23 on the pallet 20 or on the MCS 20, which rollers are driven by externally couplable drives 28.

For this purpose, one or more stations can be provided along the transport section 31 or in connection with the transport section 31, which stations establish a mechanical connection with the rollers 22, 23 and produce a rotation 3, 4, 17 of the rollers 22, 23 and thus of the coil 1.

Discharge Station 52 with Floor Rolling Station 51 (FIG. 3)

FIG. 3 shows a segment of a conveying section 31 in a hot rolling mill for producing a metal strip.

Here, as shown in FIG. 3, coils 1 are removed from two coilers 10 onto a transport carriage 20 and are transported via a "circuit" 34 to finishing or intermediate processing stations 14, 15 (here weighing station 14 and strapping station 15) (before they are then transported to a coil store 16 and deposited there (not shown or only indicated)).

In this case, as FIG. 3 illustrates, two floor rolling stations 51 are arranged along the circuit 34 (indicated).

In a manner corresponding to the pallet 20 (FIG. 1) and the MCS 20 (FIG. 2), these floor rolling stations 51 are equipped with driven rollers 22, 23 (with integrated drives 27), thereby enabling coils 1 laid there to be rotated 3, 4, 17 in accordance with a specific rotation regime (see above).

Coils 1 moved toward the floor rolling stations 51 are temporarily removed there from the transport carriage 20 and transferred to the respective floor rolling station 51, where they are rotated in accordance with a specific rotation regime (see above). After completion of the rotation regime, the coils 1 are transferred back to the transport carriage 20 and transported onward.

Continuous forward and (reverse) backward coil rotation to prevent collapse/ovalization of a coil is described in the following.

To prevent the above-described disadvantageous ovalization of a coil 1, the above-described MCS 20 can also be used as follows after a rotation regime (cf. FIGS. 1 to 3).

Here, the coil is rotated forward 3 about its longitudinal axis 2 in the first direction of rotation 5 and is rotated back 4 without a pause, i.e. without the "cycle pause"/"intra-cyclical pause", in the second, opposite direction of rotation 6, wherein the forward 3 and the reverse rotation 4 take place several times one after the other without a pause, i.e. without the "inter-cycle pause"/"pause between cycles".

Relevant regime parameters can be set in this case:

Steel grade: high-/higher-/very high-strength steel, e.g. AHSS steel

Coil weight: 20 t-30 t

Start of the rotation regime: with the start of the transport process, 1 min after removal from the coiler 10 (11)

End of the rotation regime: on completion of the transport process at the coil store 16

Number of cycles: Multiple

Cycle pause/intra-cyclical pause between the forward 3 and the (reverse) backward rotation 4: none Pause between two cycles/inter-cycle pause or pause between cycles: none Angle of rotation 8 of the forward rotation 3: 90°

Angle of rotation 9 of the (reverse) backward rotation 4: 90°

First/initial direction of rotation 5: preferably counter to coiling direction 7

Note: Preferably no rotation 3, 4 beyond the coil/strip start 12 at the outer circumference 13. Post- and intermediate processing operations 14, 15 are carried out after completion of the rotation regime.

Continuous, slow coil rotation in one and the same direction of rotation during the entire coil transport to prevent collapse/ovalization of a coil is described in the following.

To prevent the above-described disadvantageous ovalization of a coil 1, the above-described MCS 20 can also be used as follows after a rotation regime (cf. FIGS. 1 to 3).

Here, the coil is rotated 19 without interruption about its longitudinal axis 2 in one and the same direction of rotation 35 in the coiling direction 7 of the coil 1 during the entire transport process between removal 11 from the coiler 10 and deposition in the coil store 16.

Relevant regime parameters can be set in this case:

Steel grade: high-/higher-/very high-strength steel, e.g. AHSS steel

Coil weight: 20 t-30 t

Start of the rotation regime: with the start of the transport process, 1 min after removal from the coiler 10 (11)

End of the rotation regime: on completion of the transport process at the coil storage 16

Number of cycles: none, rotation only in the coiling direction Rotational speed: slow (for example at 10 min per revolution).

LIST OF REFERENCE SIGNS

1 metal coil, hot coil, coil
2 longitudinal axis
3 forward rotation
4 (reverse) backward rotation
5 first direction of rotation of the forward rotation or further rotation
6 second, opposite direction of rotation of the (reverse) backward rotation
7 coiling direction
8 angle of rotation of the forward rotation
9 angle of rotation of the (reverse) backward rotation
10 coiler
11 removal from a coiler
12 coil start
13 outer circumference
14 weighing (weighing station)
15 binding, strapping (binding station)
16 coil store
17 further rotation
18 angle of rotation of the further rotation
19 (continuous, uninterrupted) rotation
20 transport device, transport carriage, pallet, MCS car
21 coil support
22 first (driven/drivable) (transport) roller
23 second (driven/drivable) (transport) roller
24 coil/support saddle
25 first saddle support
26 second saddle support
27 integrated drive
28 external (couplable) drive unit
29 controller
30 pallet circulation system
31 conveying/transport section
32 adjustment system
33 MCS system
34 circuit
35 one and the same direction of rotation
50 transport system
51 transport station, floor rolling/floor rotating station
52 discharge station

The invention claimed is:

1. A method for preventing shape changes in metal coils, comprising:

intermittently first and second rotating a metal coil about a longitudinal axis of the metal coil, wherein the first rotating is forward in a first direction of rotation around a first angle of rotation; and wherein the second rotating is subsequent to the first rotating, in a second direction one of opposite the first direction around a second angle of rotation, and further in the first direction around a third angle of rotation;

wherein the first direction is counter to a coiling direction of the metal coil;

wherein the first rotating and the second rotating are performed so that the metal coil is not rotated beyond a coil start on an outer circumference of the metal coil;

wherein the first angle of rotation is between 22.5° and 135°; and wherein there is a rest interval between the first rotating and the second rotating.

2. The method as claimed in claim 1, wherein the metal coil is a newly wound hot coil.

3. The method as claimed in claim 1, wherein the metal coil is rotated in a cycle several times, the cycle comprising the first rotating and the second rotating.

4. The method as claimed in claim 1, wherein at least one of the following is set according to a material of the metal coil:

the first angle of rotation of the first rotating;

the second angle of rotation of the second rotating in the second direction, when the second rotating is in the second direction; and the third angle of rotation of the second rotating further in the first direction, when the second rotating is further in the first direction.

5. The method as claimed in claim 1, wherein the rest interval between the first rotating and the second rotating is set according to a material of the metal coil.

6. The method as claimed in claim 1, further comprising:

removing the coil from a coiler before the first rotating;

wherein a start of the first rotating of the metal coil after removal from the coiler is set according to a material of the metal coil.

7. The method as claimed in claim 1, wherein at least one of:

the first angle of rotation of the first rotating;

the second angle of rotation of the second rotating in the second direction, when the second rotating is in the second direction; and the third angle of rotation of the second rotating further in the first direction, when the second rotating is further in the first direction, is from a range of about 45° to 135°.

8. The method as claimed in claim 1, wherein the first angle of rotation is the same as at least one of:

the second angle of rotation of the second rotating in the second direction, when the second rotating is in the second direction; and the third angle of rotation of the second rotating further in the first direction, when the second rotating is further in the first direction.

9. The method as claimed in claim 1, wherein the rest interval between the first rotating and one of:

the second rotating in the second direction, when the second rotating is in the second direction; and the second rotating further in the first direction, when the second rotating is further in the first direction, is in a range of about 100 seconds to 300 seconds.

10. The method as claimed in claim 1, further comprising:

removing the coil from a coiler before the first rotating;

wherein the initial forward rotating of the metal coil is performed for about 100 s to 300 s after removal from a coiler.

11. The method as claimed in claim 1, wherein the metal coil consists of one of a high-carbon steel, a press-hardening steel, a multi-phase steel, and an advanced high-strength steel grade (AHSS) steel.

12. The method as claimed in claim 1, further comprising at least one of:

before the first rotating:

removing the metal coil from a coiler, binding the metal coil and weighing the metal coil; and after the second rotating, depositing the metal coil in a coil store.

13. The method as claimed in claim 1, further comprising at least one of:

sampling the metal coil;

strapping the metal coil;

weighing the metal coil, and measuring the metal coil.

14. The method as claimed in claim 1, wherein the method is carried out during a phase transformation of the metal coil from austenite to ferrite.

15. The method as claimed in claim 1, wherein the first angle of rotation is between 45° and 135°.

16. The method as claimed in claim 15, wherein the first angle of rotation is between 75° and 105°.

17. The method as claimed in claim 1, wherein the second rotating in the second direction is opposite the first direction around the second angle of rotation.

18. A transport system for preventing shape changes in metal coils, comprising:

a transport device with a coil support having at least a first rotatable and a second rotatable transport roller; and at least one external drive unit, configured to be coupled mechanically to one of the rotatable transport rollers in order to drive said transport roller;

wherein the system is configured to intermittently first and second rotate a metal coil in a first rotation and in a second rotation about a longitudinal axis of the metal coil, wherein the first rotation is forward in a first direction of rotation around a first angle of rotation; and wherein the second rotation is subsequent to the first rotation, in a second direction one of opposite the first direction around a second angle of rotation, and further in the first direction around a third angle of rotation;

wherein the first direction is counter to a coiling direction of the metal coil;

wherein the first rotation and the second rotation are performed so that the metal coil is not rotated beyond a coil start on an outer circumference of the metal coil; and wherein there is a rest interval between the first rotation and the second rotation.

19. The transport system as claimed in claim 18, further comprising a controller coupled to the transport device and the at least one external drive unit, the controller configured to perform the first rotation and the second rotation.

20. A transport system for preventing shape changes in metal coils, comprising:

a transport device with a coil support having at least a first rotatable and a second rotatable transport roller;

at least one drive unit configured to drive said transport roller; and a controller coupled to the transport device and the at least one drive unit, the controller configured to intermittently first and second rotate a metal coil in a first rotation and in a second rotation about a longitudinal axis of the metal coil, the first rotation being forward in a first direction of rotation around a first angle of rotation, the second rotation being subsequent to the first rotation and in a second direction one of:

opposite the first direction around a second angle of rotation, and further in the first direction around a third angle of rotation;

wherein the first direction is counter to a coiling direction of the metal coil;

wherein the first rotation and the second rotation are performed so that the metal coil is not rotated beyond a coil start on an outer circumference of the metal coil; and wherein there is a rest interval between the first rotation and the second rotation.

* * * * *